United States Patent [19]

Mason

[11] Patent Number: 4,890,676

[45] Date of Patent: Jan. 2, 1990

[54] APPARATUS AND METHOD FOR LINING BORE HOLES WITH PRE-FORMED LINING SHELLS

[75] Inventor: Benjamin Mason, Normanton-on-Trent, Great Britain

[73] Assignee: Caledonian Mining Co. Ltd., United Kingdom

[21] Appl. No.: 256,703

[22] Filed: Oct. 12, 1988

[51] Int. Cl.[4] ..... E21B 43/10; E21D 5/01

[52] U.S. Cl. ..... 166/380; 405/150

[58] Field of Search ..... 166/380, 285; 405/146, 405/150, 151, 152, 153

[56] References Cited

U.S. PATENT DOCUMENTS

| | | | |
|---|---|---|---|
| 3,250,076 | 5/1966 | Jenkins et al. | 61/41 |
| 3,640,076 | 2/1972 | Rees et al. | 405/152 |
| 4,460,293 | 7/1984 | Richardson et al. | 405/150 |

FOREIGN PATENT DOCUMENTS

| | | | |
|---|---|---|---|
| 0170199 | 2/1986 | European Pat. Off. | 166/285 |
| 3446804 | 7/1985 | Fed. Rep. of Germany | 405/146 |
| 1559149 | 3/1969 | France | 405/146 |
| 0858907 | 7/1957 | United Kingdom . | |
| 0906263 | 9/1962 | United Kingdom . | |

*Primary Examiner*—Bruce M. Kisliuk
*Assistant Examiner*—Terry Lee Melius
*Attorney, Agent, or Firm*—Wood, Herron & Evans

[57] ABSTRACT

A method and apparatus for producing a bore hole lining from a number of pre-formed shells is described. The shells are assembled on a lower frame which is lowered into the bore hole by a predetermined distance in a series of steps, each step being of a length corresponding to the depth of each shell loaded, the frame being lowered after each shell is assembled thereon. The frame and batch of assembled shells so formed is then lowered to the lowest unlined portion of the bore hole. Grout is poured around the shells and allowed to set and the lower frame is detached from the batch and withdrawn. This method and apparatus allows relatively long bores to be lined.

16 Claims, 5 Drawing Sheets

APPARATUS AND METHOD FOR LINING BORE HOLES WITH PRE-FORMED LINING SHELLS

This invention relates to the lining of bore holes and in particular to such bore hole extending between two or more levels in a mine.

When inserting a lining (e.g. of steel, pre-cast concrete or other suitable material) for a bore hole extending down from one mine level to another, there is insufficient head room to insert an assembled lining so the lining has to be assembled in situ from a number of pre-formed shells each having a relatively short axial length.

If a number of shells are assembled piece by piece at the floor of the upper level and lowered, two main problems arise, namely, (a) that if the length of the bore hole exceeds say 70 meters the length/diameter ratio becomes unacceptably large leading to possible structural failure, and (b) the necessary grouting between the lining and the wall of the bore hole is very difficult to establish without the formation of voids which subsequently cause distortion and destruction of the linings.

These problems are solved to a large extent by a method of producing a bore hole liner from a number of pre-formed shells in accordance with the invention wherein the shells (or half shells) are assembled one by one onto a lower frame which is lowered into the bore hole by a predetermined distance of, for example, 4 to 8 meters in a series of steps, each step being of a length corresponding to the depth of each shell loaded, lowering the batch of assembled shells so formed until the bottom surface of the lowermost shell contacts the bottom of the bore hole (or a plinth located at the bottom) or the top of the last batch of assembled shells, causing grout to be discharged from the top of the batch of shells, around the batch of shells and allowing the grout to set, the lower frame being then detached from the batch and drawn up through the shells to receive a new batch.

Thus each batch of shells is supported from below; the lowering of the shells into the hole is safe and effective and as the grouting is only supplied for a length corresponding to that of a batch it can be positioned around the shells without difficulty and the formation of voids and with each grouting placement, which takes time to set, being of a reasonable length the overall placement time is kept to a reasonable limit. Lengths of lining of say 200 meters can be efficiently positioned.

Apparatus for lining bore holes with the pre-formed liner shells in accordance with the invention comprises a lower and an upper frame the lower having means for releasable attachment to a shell and the upper having means for distributing grout around the periphery of a batch of shells supported on the lower.

The upper frame is preferably provided with one or more guide ropes or cables which extend down the hole under tension the lower frame being arranged to run up and down those ropes or cables.

The upper frame is conveniently provided with means for supplying grouting around shells positioned in the bore hole, which means may comprise four outwardly movable nozzles arranged in pairs at 90° so that when extended the nozzles help to centralise the upper portion of a batch of shells.

The invention will now be described by way of example with reference to the accompanying diagrammatic drawings in which.

Figure 1:
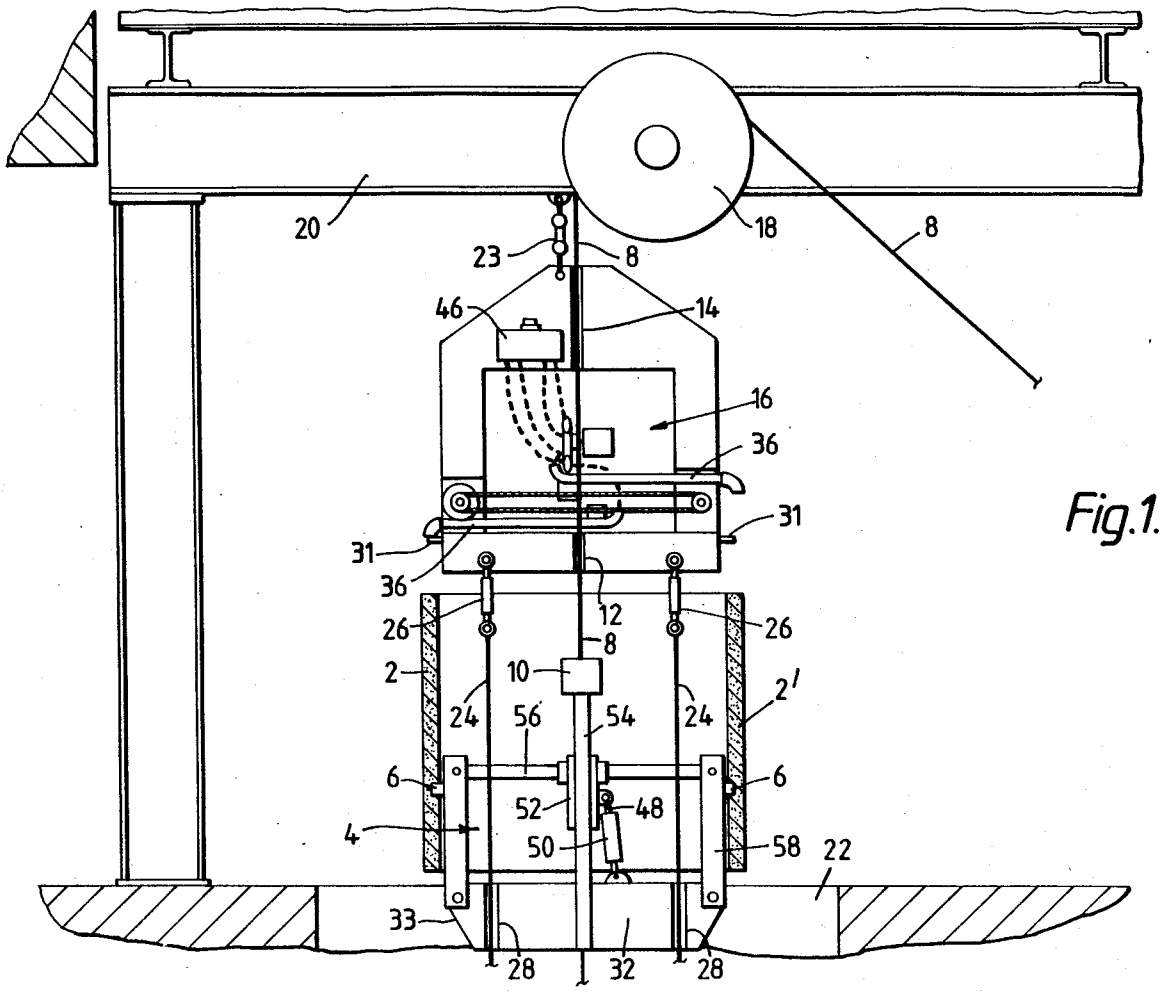
FIG. 1 shows one embodiment of apparatus in accordance with the invention having received a first or lowermost shell of a liner batch to be inserted into a bore hole.
Figure 2:
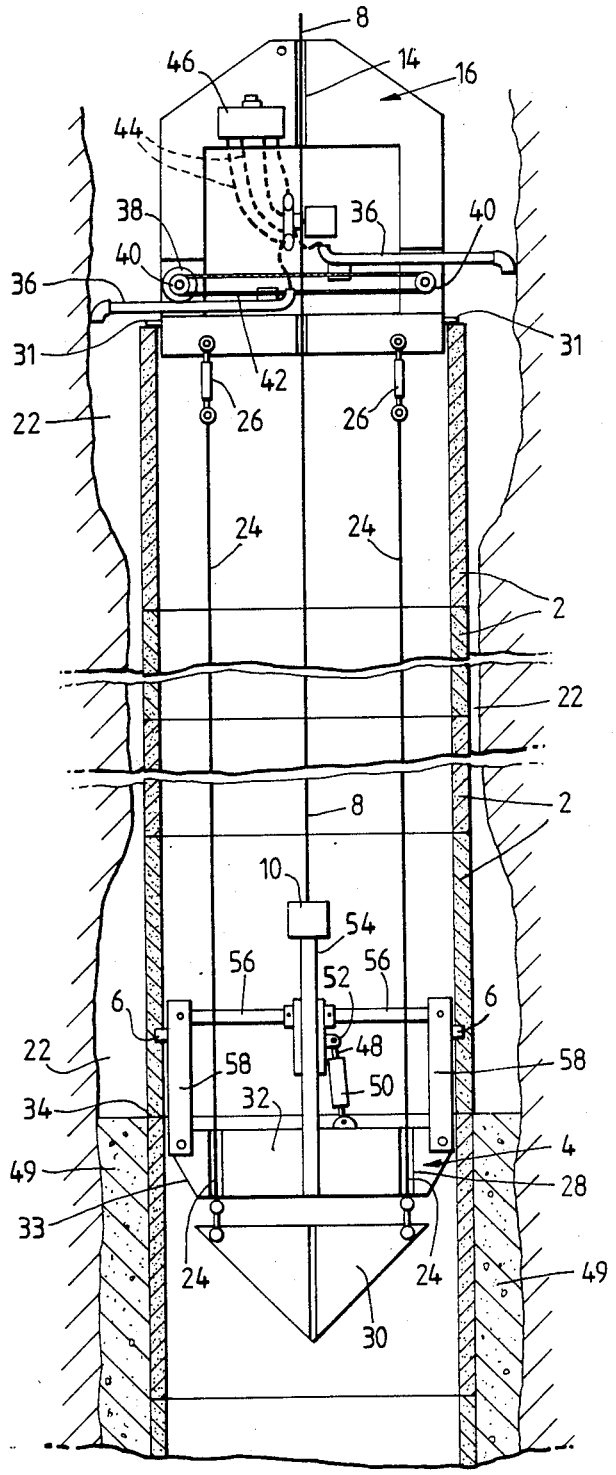
FIG. 2 shows a batch of liner shells lowered into position in the bore hole and ready for grouting and, FIG. 3 shows the apparatus being withdrawn from the bore hole ready to receive a new batch of shells.
Figure 3:
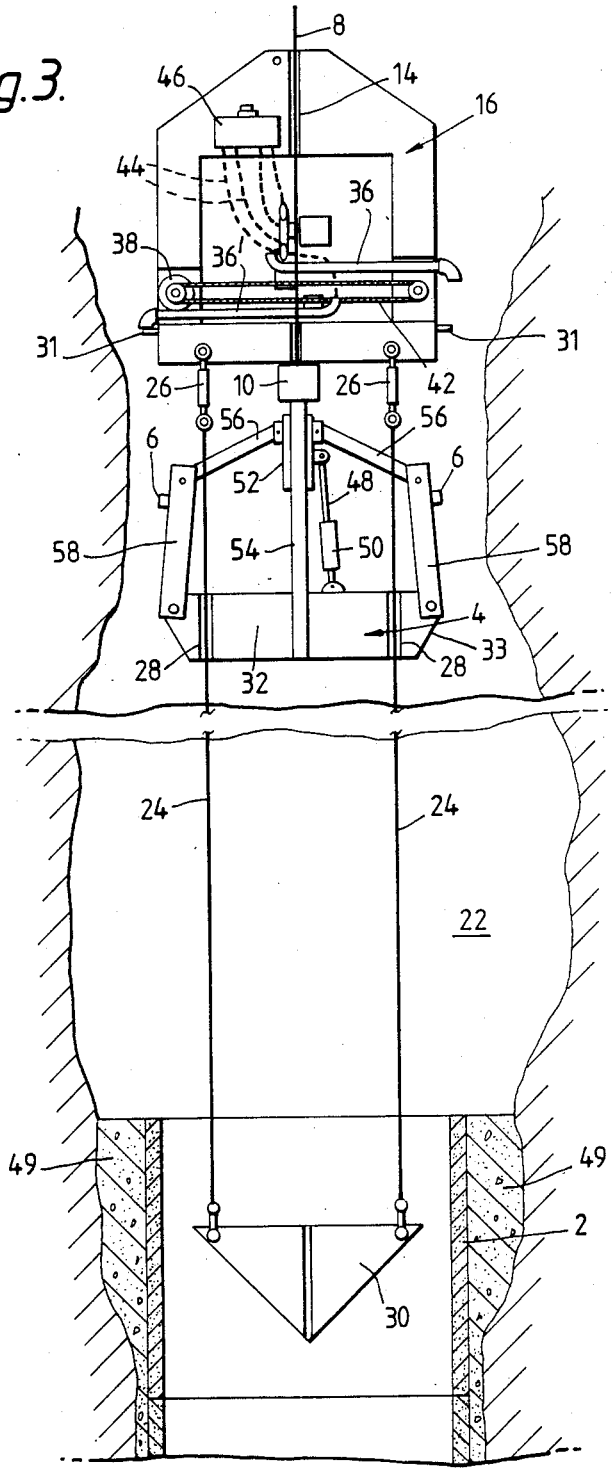

Referring to FIGS. 1 to 3 and in particular FIG. 1, two half shells 2 of reinforced concrete or the like are assembled together around a lower platform generally indicated at 4 of the bore hole lining apparatus in accordance with the invention. The half shells are wired together to hold them in position on the frame. After the two half shells are in position they are engaged by pins 6 forming part of a latch mechanism, to hold the shells on the lower frame.

The lower frame is supported by a winch rope 8 which is clamped to the frame at 10 and extends upwardly through bores 12, 14, in the lower and upper faces respectively of an upper frame generally indicated at 16. The winch rope 8 then passes over a pulley 18 mounted on a beam 20 positioned above the bore hole 22 which it is desired to line.

The winch rope 8 after passing around its pulley 18 passes to a winch (not shown).

On loading, the upper frame 16 is in the position shown in FIG. 1 connected to the underside of the beam 20 by a detachable clamp 23.

The lower side of the upper frame 16 has two guide ropes 24 secured thereto through tensioning device 26. The guide ropes 24 extend down through the shells mounted on the lower frame and through holes 28 in the bottom member of the lower frame. The lower ends of the guide ropes are connected as can be seen in FIG. 2 to a triangular member 30 which is anchored by means not shown to the bottom of the bore hole 22 or to a counter weight which acts to tension the guide ropes 24

Once the first pair of half shells has been assembled on the lower frame as seen in FIG. 1, the winch rope 8 is played out allowing the lower frame to slide down the guide ropes 24 away from the upper frame 16 which is anchored at 23, for a sufficient distance to enable a second pair of half shells to be assembled on top of the first pair of shells 2.

This procedure is repeated until four pairs of half shells are assembled on the lower frame to form a batch as can be seen in FIG. 2. The upper frame is then detached from its clamp 23 and projecting pins 31 then engage the top surface of the uppermost pair of preformed shells 2. The turnbuckles 26 are then tightened to squeeze the shells together.

If desired mastic or the like is spread over the joints between the two half shells and between one pair of half shells and another during assembly and before the shells are lowered into the bore hole.

In the position ready for lowering, it will be seen from FIG. 2 that the bottom member 32 of the lower frame 4 has reached the top of the anchoring member 30 of the guide ropes 24.

The winch is then operated to lower the two frames and the assembled lining shells down in to the bore hole as and until the lowermost face 34 of the lowermost pair of half shells of the batch being lowered, engages the top of the face of the uppermost pair of shells of the last batch to be placed in the bore hole, or alternatively, until the lowermost shell reaches a plinth at the bottom of the bore hole.

The position shown in FIG. 2 is then reached.

It will be appreciated that the tapering shape 33 of the base member 32 of the lower frame causes the bottom portion to engage in the open end of the uppermost pair of lining shells already in position so as to centralise the lower end of the batch of shells.

The upper frame 16 is then centralised in the bore hole by extending out two pairs of grouting nozzles 36 -at right angles to each other until they engage the inner surface of the bore hole. This outward movement is achieved by e.g., an air motor 38 driving a sprocket 40 and chain diagrammatically indicated at 42. The grout nozzle members are connected by means of flexible pipes 44 to a distribution manifold incorporating a "dump"valve 46. When the nozzles are in the outermost position with the batch of shells alligned with the access of the bore hole then grout is pumped down out from the nozzles to flood over the five meters section of the bore hole made up of the four pairs of half shells. It is envisaged that these shells could conveniently extend over a length of 4–8 meters.

A level indicator (not shown) acts to issue a warning when the grout approaches the top edge of the top pair of half shells of the batch and a switch is operated to "dump"any remaining grout down the centre of the bore hole and to pass flushing water through the system.

The in situ grouting 49, is then allowed to set.

When the grout is set a latch between the lower frame and the lowermost pair of half shells is opened by extension of the piston 48 of a cylinder 50 causing a tubular member 52 to move upwardly on a shaft 54 causing pivoted arms 56 which extend between the member 52 and one end of arms 58 to move outwardly. The arms 58 carry the latch pins 6 and which are themselves pivotally connected both to the outer end of arms 56 and to the base 32 of the bottom member of the lower frame. Thus the pins 6 are drawn inwardly to the position shown in FIG. 3 and out from the holes in the lower pair of lining shells in which they had previously been engaged.

The assembly of upper and lower frames can then be winched up the bore hole as seen in FIG. 3 to the position shown in FIG. 1 where they receive further lining shells.

Figure 4:
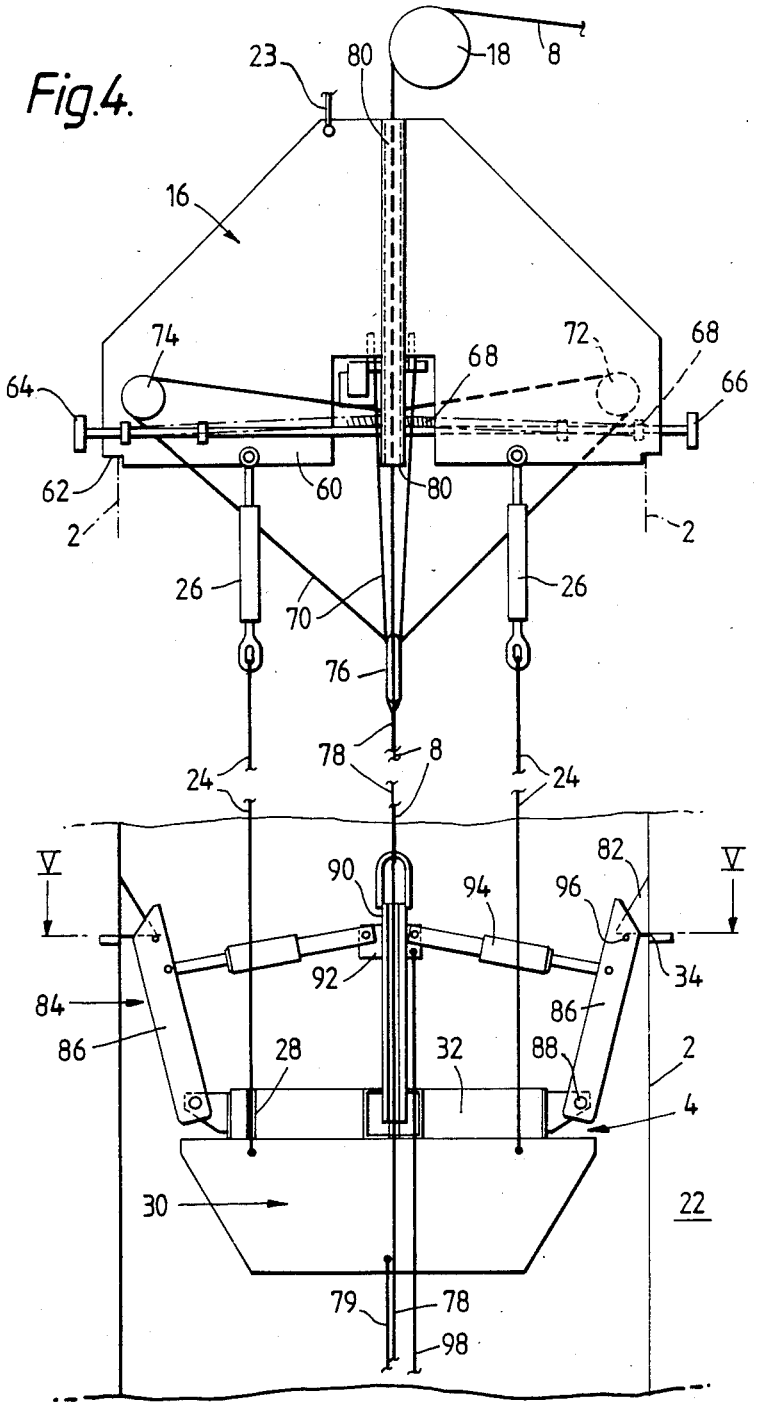
FIG. 4 shows a second embodiment of an apparatus in accordance with the invention.

The apparatus shown in FIG. 4 operates in a similar fashion to that described above with reference to FIGS. 1 to 3 and the same reference numerals have been used for those parts which are identical. Only the main differences between the two apparati will therefore be described.

The apparatus is shown in the position where the four pairs of half shells have been assembled on the lower frame to form a batch and the two frames 4 and 16 together with the batch have been lowered until, as shown, the lowermost face of the lowermost pair of half shells has engaged with the top face of the uppermost pair of shells of the last placed batch or, alternatively, until it reaches a plinth at the bottom of the bore hole. The upper frame 16 is not provided with projecting pins but rather has a collar 60 of the same diameter as the shells 2, the shoulder 62 between the collar 60 and the remainder of the upper frame 16 engaging with the top surface of the uppermost pair of shells so that the upper frame is supported on the shells when it is detached from clamp 23.

The upper frame 16 is then centralised in the bore hole by extending out four guide members only two of which 64 and 66 are shown at right angles to each other, until they engage the inner surface of the bore hole. The guide members are movable relative to the upper frame and in their normal position are held close to the frame by tension springs 68 which are attached between the outer end of one guide member and the inner end of the diametrically opposite guide member.

One end of a rope 70 is attached to the inner end of guide member 64, extends round pulleys 72 and 74 and is attached at its other end to the inner end of guide member 66. The middle of the rope between the two pulleys 72 and 74 is secured to a ring 76. The other two guide members are interconnected in the same way, the middle of the connecting rope also being secured to ring 76. To cause the guide members to move outwards relative to the upper frame 16, a rope 78 secured to the ring 76 is pulled downwards by a device strong enough to overcome the resistance of the tension springs 68. The force on the rope 78 pulls each half of the ropes 70 around the pulleys and urges the guide members outwards to contact the bore hole.

To ensure that the shells are held closely together a rope 79 secured to the upper frame 16 may be provided which can be pulled from below to force the assembly downwards.

Grout is then pumped down a large bore pipe 80 secured to one side of the upper frame member 16, the mouth of which extends just below the bottom of the upper frame member, from a grout supply via a supply nozzle (not shown) which is simply inserted into the pipe 80 when required. This separation of the supply hose and the grout sprayer obviates the need to have a supply hose which is sufficiently long to allow it to raise the height of a batch of shells at the end of each lining operation. It has been found that the single pipe 80 will adequately fill the space between the lining and the bore hole.

The grout is then allowed to set.

When the grout is set, a latch between the lower frame 4 and the lowermost pair of half shells is opened. The latch is provided between four fins 82 which are provided on the lowermost pair of half shells (see FIG. 5) and a latch mechanism—generally indicated by 84.

The latch mechanism 84 comprises four locking arms 86, each of which comprises two parallel spaced stripes and one end of each of which is pivoted, see 88, to the lower frame 4. A rod 90 is secured to the middle of the lower frame 4 and has a sleeve 92 which is dimensioned so that it can move freely thereon. Secured to the ring 92 is one end of four spring loaded dampers 94, the other ends of which are connected to the locking arms 86.

The latching mechanism 84 has two stable positions, the first of which is shown in FIG. 4 with the ring 92 at the top of the rod 90 and the locking arms 86 at an angle of about 60° to the horizontal. It is in this position that the latch is formed since, with the latching mechanism in this stable position, when the first pair of half shells is placed on the lower frame the fins 82 rest on pins 96 which extend between the two strips forming the locking arms 86 to latch the lower frame 4 to the pair of shells.

To open the latch, the ring 92 is pulled downwards by applying a force to a rope 98 secured thereto. Once the sprung loaded dampers 94 become approximately horizontal, the system is unstable and the ring continues to move downwards by itself to bring the mechanism into the second stable position where the locking arms 86 point in towards the rod 90. The pins 96 are thus forced out of contact with the fins 82 and the assembly of upper and lower frames can be winched up the bore hole back to the starting position for a new operation. Before the next lining operation is begun the latching mechanism is reset in the first stable position so that when the first set of half shells are placed on the lower frame, the latch between them and the lower frame will be engaged.

Figure 5:
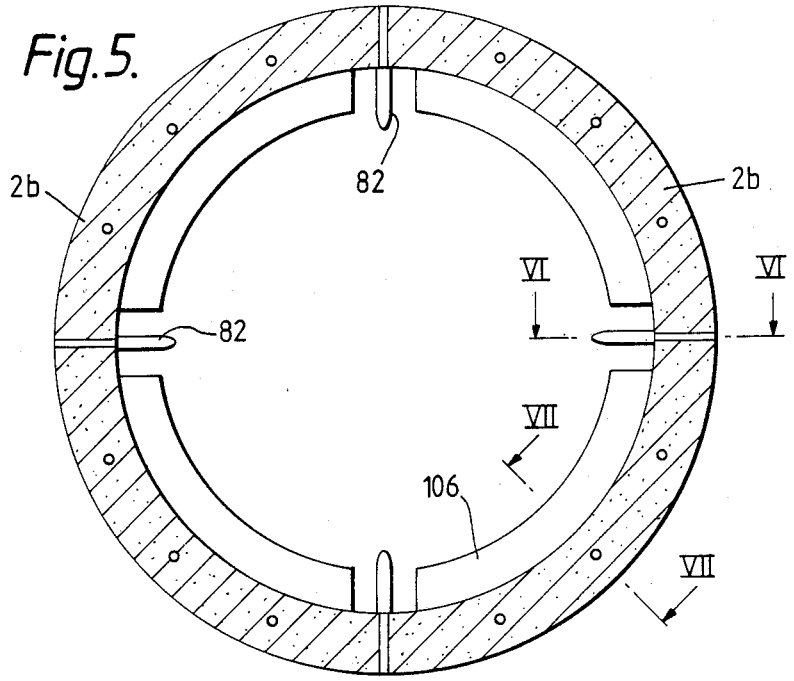
FIG. 5 is a view in the direction of V—V of the lining of FIG. 4.
Figure 6:
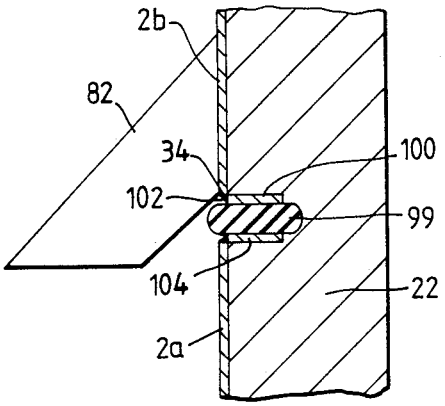
FIG. 6 is a section along line VI—VI of the lining of FIG. 5.

The fins 82 are shown in more detail in FIG. 5 and in particular in FIG. 6 which shows part of the uppermost pair of half shells 2*a* of one batch and the lowermost pair of half shells 2*b* of a second batch which is positioned above the first batch. The fins 82 protrude below the bottom face 34 of the pair of half shells 2*b* and therefore help to guide them into position on the pair of half shells 2*a*.

It has been found that there is a tendancy for the batch to 'float' in the grout that is to move away from the already placed batches and for this reason a layer of rubber sealant 99 is placed on a ring 100 welded (see 102) to the bottom face 34 of the pairs of half shells. This layer 99 becomes compressed between the ring 100 and a corresponding ring 104 welded to the top face of the adjacent pair of shells to hold them together.

Figure 7:
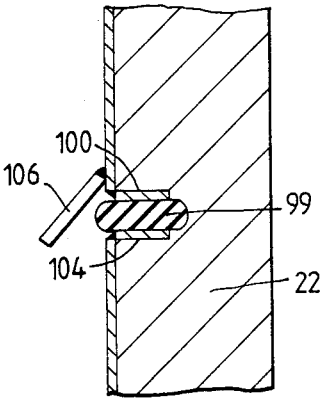
FIG. 7 is a section along line VII—VII of the lining of FIG. 5

The lowermost pair of shells of a batch also has four strips of metal 106 welded thereto between the fins 82. As can be seen in FIG. 7, these are positioned so that they protrude below the bottom face 34 of the pair of shells. These strips of metal 106 serve to aid location of one batch in the batch below and also to hold in the rubber seal 99. Furthermore, when the lining is in place and rubble etc. is passed down the bore the strips 106 are flatteneed against the pairs of half shells 2*a* and 2*b* and hammered down to overlap the joint between the two pairs of half shells and protect this.

Instead of the latch between the lower frame and the lowermost pair of shells being provided by pins engaging in holes or with latch members on the inside surface of the shells, the latch can be constituted by an inflatable member which grips the inside surface of the shells.

The shells themselves may be made of any normal bore hole lining material e.g. steel, glass reinforced plastic, reinforced concrete or the like.

What I claim is:

1. A method of producing a bore hole lining from pre-formed shells, said method comprising the steps of assembling more than one of said shells one by one onto a lower frame which is lowered into said bore hole by a predetermined distance in a series of steps, each step being of a length corresponding to the depth of each shell loaded, thereby providing a batch of shells on said lower frame, lowering an upper frame onto said batch of shells before said batch is lowered down the bore hole, drawing said upper frame and lower frames together before said batch is lowered down said bore hole to clamp together said shells forming said batch, lowering said batch of assembled shells so formed until the bottom surface of the lowermost shell contacts either the bottom of said bore hole or the top of a previously lowered shell, causing grout to be discharged around said batch of shells and allowing said grout to set, disassembling said lower frame from said batch, and drawing said lower frame up through said batch of shells preparatory to assembling a new batch of shells thereon.

2. A method as claimed in claim 1, said method comprising the step of latching said lowermost shell to said lower frame when said shells are assembled onto said lower frame.

3. A method as claimed in claim 2, said method comprising the step of unlatching said lowermost shell from said lower frame prior to drawing said lower frame up through said batch of shells.

4. A method as claimed in claim 1, said grout being discharged from means provided on said upper frame.

5. A method as claimed in claim 1, said method comprising the step of centralizing said upper frame relative to said bore hole before grout is discharged around said batch of shells.

6. A method as claimed in claim 1, said method comprising the step of drawing said upper frame upwardly as said lower frame is drawing upwardly.

7. Apparatus for lining a bore hole with a batch of pre-formed lining shells, said apparatus comprising a lower frame onto which plural pre-formed shells may be assembled to form a batch thereof, a releasable attachment device mounted on said lower frame, said attachment device being adapted to hold at least one shell in said batch in assembled relation with said lower frame, an upper frame connected with said lower frame, said upper frame being movable relative to said lower frame in order to permit said plural shells to be positioned therebetween, a clamping device connected to said upper frame, said clamping device permitting said upper frame to move into clamping relation with said batch after said batch has been assembled on said lower frame in order to hold the shells of said batch together on said lower frame in said assembled relation, means for lowering said upper and lower frames down said bore hole with said batch clamped therebetween, and a grout distributor connected to said upper frame, said grout distributor being adapted to discharged grout into the cavity between said batch and said bore hole after said batch has been lowered to its desired final location.

8. Apparatus as claimed in claim 7, said releasable attachment device comprising at least one pin mounted on said lower frame, said pin being movable between a first position in which it is engaged with a shell and a second position in which it is disengaged from said shell.

9. Apparatus as claimed in claim 8, one shell of each batch comprising structure defining at least one hole defined in said shell, said shell hole being adapted to cooperate with said pin.

10. Apparatus as claimed in claim 8, one shell of each batch comprising at least one wedge secured to said shell, said wedge being adapted to cooperate with said pin.

11. Apparatus as claimed in claim 10, at least part of said wedge protruding below the lower end of said shell.

12. Apparatus as claimed in claim 7, said apparatus comprising a let down device connected to said lower frame, said let down device being adapted to lower said lower frame down said bore hole.

13. Apparatus as claimed in claim 7, said apparatus comprising at least one guide rope connected to said upper frame, said guide rope being adapted to extend down said hole, said lower frame being adapted to run up and down said guide rope as it is raised and lowered within said bore hole.

14. Apparatus as claimed in claim 7 at least one of said shells comprising an alignment device for locating said one shell on another shell with their axes coincident one with the other.

15. Apparatus as claimed in claim 7, said apparatus comprising means for engaging said upper frame with a shell.

16. Apparatus as claimed in claim 7, said apparatus comprising a centralizing device for centering said upper frame in said bore hole after said batch has been lowered to its desired final location.

* * * * *